US005879164A

United States Patent [19]

De Jesus

[11] Patent Number: 5,879,164

[45] Date of Patent: Mar. 9, 1999

[54] GOLF SWING TRAINER WITH ANGLE GUIDE

[76] Inventor: Cesar L. De Jesus, 12314 Coral Reef Dr., Orlando, Fla. 32826

[21] Appl. No.: 905,002

[22] Filed: Aug. 11, 1997

[51] Int. Cl.[6] ..... A63B 69/36

[52] U.S. Cl. ..... 434/252; 473/227; 473/258

[58] Field of Search ..... 434/252; 473/226, 473/227, 219, 257, 258, 231, 235

[56] References Cited

U.S. PATENT DOCUMENTS

| | | | |
|---|---|---|---|
| 3,844,569 | 10/1974 | Swanson | 273/192 |
| 5,096,199 | 3/1992 | Wyatt, Jr. . | |
| 5,116,056 | 5/1992 | Schmutte . | |
| 5,125,664 | 6/1992 | Evans | 434/252 X |
| 5,197,739 | 3/1993 | Johnson . | |
| 5,209,482 | 5/1993 | Hopfer . | |
| 5,263,719 | 11/1993 | Bunn . | |
| 5,265,876 | 11/1993 | Moon . | |
| 5,294,126 | 3/1994 | Armstrong . | |
| 5,441,270 | 8/1995 | Williams | 473/242 |

*Primary Examiner*—Kien T. Nguyen

[57] ABSTRACT

A golf club having a head equipped with a visible elongated angle guide, said head having a club face, and said visible elongated angle guide is in a predetermined position with respect to the said club face, whereby the golfer is able to align to the proper position and desired relationship the said elongated angle guide and the said club face with respect to a fixed visible line marker on the ground and the ground surface before the swing, at the address position and during the swing before and after the said club strikes the ball. The elongated angle guide may be removable and easily disassembled from the club head to fit in the golf bag.

14 Claims, 7 Drawing Sheets

GOLF SWING TRAINER WITH ANGLE GUIDE

BACKGROUND OF THE INVENTION

This invention relates to a golf training device developed for the purpose of training a golfer to develop a correct and effective swing, with the principal purpose being to show the golfer an instantaneous visual geometric results of his swing.

Most golfers swing their golf club to hit the ball hoping they will create a good swing. A golf swing is very complicated inasmuch as almost all parts of the moving body are involved, including the head, arms, legs, hips, shoulders, and feet of the golfer.

The relative position of the golf club with respect to the body is also very important. To execute a correct golf swing, it is necessary to maintain the correct static position and to maintain the correct dynamic positions and alignment of the body and club during the swing. The only way a golfer can see if he or she has made a mistake is by looking at the flight of the ball. A guess on swing adjustment is normally accomplished by the golfer changing a single aspect of his or her swing without taking fully into consideration, the fact that there are not one but many factors affecting the swing.

Except for the putter, almost all clubs have grooves, and every golf ball has dimples on its surface. The physical contact between the clubface and the ball generate friction, making the ball spin. If the club face is not maintained by the golfer in a square relationship with the ball, different flights of the golf ball can result, bringing about a slice, hook, fade, cut, etc.

Various attempts have been made to design a golf trainer, but up into the present time, none has been successful due to practicality, such as physical sizes of the trainer, weight of the trainer, and limitation of the trainer, not to mention cost. Some trainers require a room full of apparatus to be used only indoors, and some require wall restraints, and still others restrict only some parts of the body.

In contrast with the prior art devices, the instant invention is practical and simple, and it can be used anywhere.

SUMMARY OF THE INVENTION

My invention monitors the most important part of the golf swing, which involves the impact of the golf club face with the golf ball. It is clear that the direction of the flight of the ball is dependent upon the position of the club face with respect to the imaginary line between the ball and the target.

In accordance with my invention, I have provided novel components serving to provide a clear visual effect of the most important part of the swing, which involves the impact of the club face with the golf ball. The novel components provided in accordance with this invention involve a man-made visible reference line marker which can be used to simulate the imaginary line between the ball and the target, and most importantly, the addition of an elongated component parallel to the club face, showing the geometric position of the club face with respect to the line of flight of the ball to the cup.

An important feature of the instant invention involves the fact that my novel trainer provides an accurate feedback to the golfer, so he or she can make any necessary adjustment with respect to his or her static position, or to dynamic positions and alignment.

Significantly, my invention utilizes a novel angle guide, which can be adapted to any existing golf club, which makes it practical for every golfer who prefers to use a particular club.

It is thus to be seen that my invention is an enhancement or magnification of what every golfer is trying to accomplish, which is to hit the ball squarely with the club face. When the lines or on the club face at impact are parallel to the ground, and the club face is perpendicular to the imaginary line between the target and the ball, the hit is square, making the ball move forwardly in the desired direction.

A primary object of my invention is therefore to provide a golfer with a highly effective self-training device, which device is usable with a variety of different clubs.

Another object of my invention is to provide golfers with a training device that can be used indoors or outdoors, and that can be used on the driving range as well as on a golf fairway.

Yet another object of my invention is to provide golfers with a training device for different shots, and to make this possible, different clubs for a particular shots can be modified in a highly effective way in accordance with this invention.

It is still another object of my invention to provide a highly advantageous elongated angle guide that can be rapidly and removably added to the head of an essentially conventional golf club so as to aid the golfer in learning to hit the ball in the direction of the target.

It is yet still another object of my invention to provide a highly advantageous elongated angle guide that can be rapidly added to the head of an essentially conventional golf club during practice, but thereafter readily removed before the time of game play, with this advantageous construction utilized in order to allow the club to fit in the golf bag.

It is still another object of my invention to provide a golfer with a training device for making shots such as slice, hooks, cut shots and fades, with this invention making it possible to measure the angle between the intended target line and the club face, therefore establishing the particular angle that can be used to make the required shots.

It is still another object of my invention to provide golfers with an accurate guide for compensation on the uphill or downhill shots.

It is still another object of my invention to provide an angle guide that can be rapidly and removably added to the head of an essentially conventional golf club and that, while changing somewhat the mass and center of gravity of the club head, will not have an adverse effect, but rather will improve the golfer's swing.

These and other objects, features and advantages will become more apparent from a study of the appended drawings of certain exemplary embodiments of my invention.

DETAILED DESCRIPTION

Figure 1:
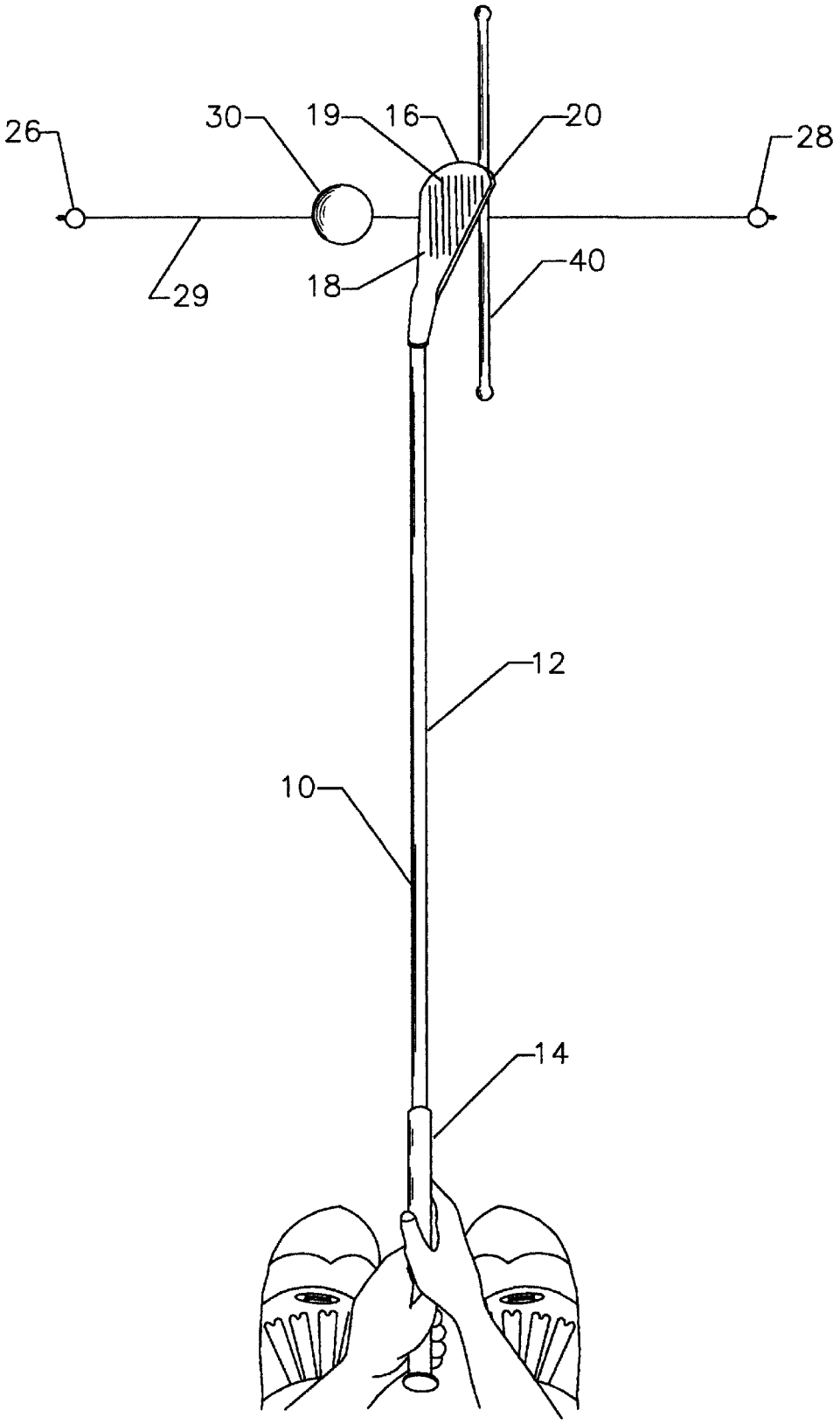
FIG. 1 is a view taken from above, showing a golfer holding a golf club modified in accordance with this invention to utilize a novel elongated angle guide intended to aid the golfer hitting a ball at the angle necessary for making the required shots.

With initial reference to FIG. 1, it will there be seen that I have shown a typical embodiment of my novel golf training practice apparatus for indoor as well as outdoor utilization, to be of assistance to a golfer endeavoring to acquire skill in hitting a golf ball in a selected direction. It will be seen from this figure that I have shown a golf club 10 having a shaft 12 upon which a handle 14 is mounted, and having a head 16 at the end of the shaft opposite the handle 14. Also revealed in this figure is the fact that the head 16 has a face 18 as well as a top side 20. Extending across the face are a conventional series of parallel grooves 19.

Figure 2:
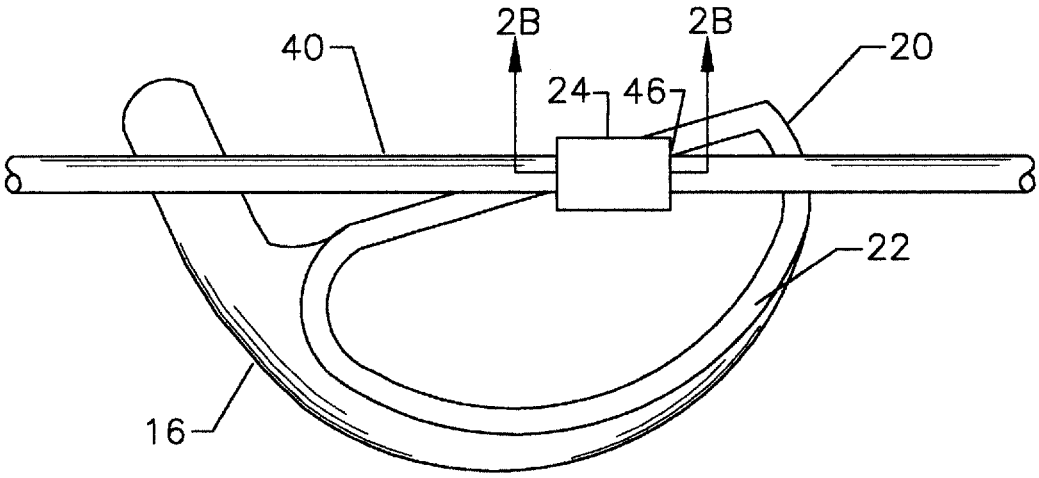
FIG. 2 is a view to a somewhat larger scale, showing how in accordance with one embodiment of my invention, my novel elongated angle guide can be mounted on the backside of a club having an iron head, with it to be understood that the so-called iron club head could be metal or a combination of metal or non metal.

From FIG. 2 it can be seen that the head 16 has a rear side 22, upon which a first embodiment of an angle guide supporting means 24 is mounted, with the means 24 being provided for the support of the novel elongated angle guide forming a principal aspect of this invention. A first embodiment of my novel elongated angle guide 40 is depicted in FIG. 1. As will be disscussed at some length hereinafter, more than one form of the angle guide supporting means can be utilized in accordance with this invention, with the type of supporting means used in a given instance largely depending upon the configuration or construction of the club.

The head 16 is shown in FIG. 1 to be resting on a reference line marker 29, which extends generally in a left-right direction and in approximately a right-angle relationship with the shaft 12 of the golf club. It is to be understood that the elongated angle guide 40 is in a perpendicular or right- angle relationship with with the reference line marker 29.

The reference line marker in this instance may be a string supported between devices 26 and 28 that bear a general resemblance to golf tees, with the string 29 being held in a taut relationship to form a straight line on the ground. The primary function of the reference line marker is to provide a guide for the path of travel for the club head during the swing before and after the club strikes the ball. The reference line marker 29 shown on FIG. 8 with the tee posts 26, 27 and 28 is intended to be used on the fairway where there is grass.

The golfer use the reference line marker on the fairway by aligning it pointing towards the target, setting the tee posts to make the reference marker taut, straight and parallel to the ground surface. The middle tee post 27 holds the golf ball 30. The purpose of the slotted hole on the tee post is to allow for the height adjustment of the middle tee post 27 without disturbing the the reference line marker. A regular tee placed in the middle and adjacent to the reference line marker could be used to hold the golf ball instead of the middle tee post 27. It is to be understood that the reference line marker could be made from different materials or form depending on the surface. On concrete or hard wood floor the reference line marker could be made with visible paint, chalk marks or adhessive tape. For indoors a piece of carpet with a visible straight line painted on it or a straight visible line built in with the piece of carpet could be used for the reference line marker.

Quite significantly, I reveal in FIG. 1 that my novel elongated angle guide 40 is mounted on the rear side of the head 16 of the golf club. The angle guide is intended to be of considerable assistance to the golfer in helping him or her improve his or her golf swing, without impairing the ability of the golfer to hit the ball. Certain users of my device have reached the conclusion that the addition of my device actually helps improve the swing of the club.

Returning to a consideration of FIG. 2, it is to be noted in this imbodiment of my invention that the angle guide supporting means 24 is secured upon the rear side 22 of the club head 16, that is, the side opposite the face 18. The supporting means 24 can for example be welded upon the backside of the club head at a time subsequent to its manufacture, or, alternatively, it can be provided on the backside of the clubhead by the manufacturer at the time the clubhead is being created.

Figure 2A:
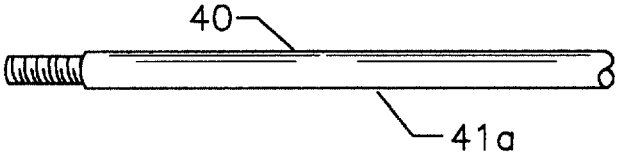
FIG. 2A is a fragmentary view of a typical elongated angle guide component, having screw thread at one end.
Figure 2B:
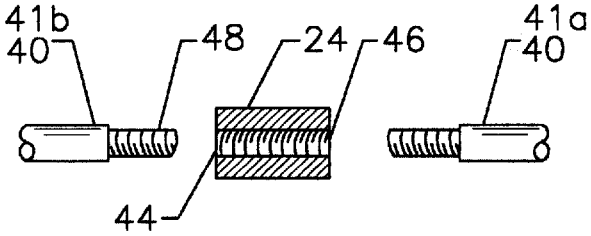
FIG. 2B is a cross-sectional view of the support for a pair of angle guide components of the type illustrated in FIG. 2.

In this particular embodiment of my invention, the angle guide supporting means 24 is provided with a hole 44 extending therethrough, which hole is equipped with threads 46; note FIG. 2B. It is to be understood that the hole 44 is in a parallel relationship to the laterally extending grooves 19 vissible in FIG. 1 as having been provided on the face 18 of the club head.

The threads 46 provided on the interior of the supporting means 24 enable the ready mounting of the elongated angle guide member 40. In the particular instance illustrated in FIGS. 2 and 2B, I prefer for the elongated angle guide member 40 to be made up of separate components 41*a* and 41*b*, with male threads 48 utilized on the inner ends of both of these components. The components 41*a* and 41*b* are substantially identical. Note in FIG. 2A that I have provided a somewhat fragmentary illustration of component 41*a* . This arrangement involving the threaded components 41*a* and 41*b* enables the golfer to install the angle guide members by merely rotating each part of this device in his or her fingers so as to cause the male threads 48 on the end of the respective angle guide member to operatively engage the internal threads 46 located in the interior of the angle guide supporting means 24. It is to be understood that the angle guide could be regid or flexible, or built extendable. The elongated angle guide 40 can be permanently welded or glued to the supporting means 24.

Figure 3:
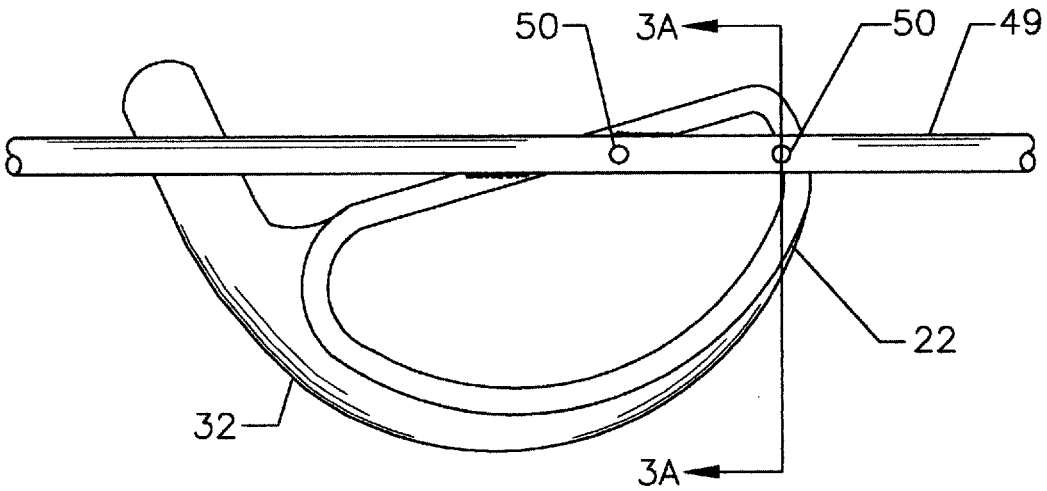
FIG. 3 is a view also to a somewhat larger scale, showing another embodiment of my novel elongated angle guide, in this instance integrally mounted on an iron club head.

With reference now to FIG. 3, in this embodiment I have shown a version of my novel elongated angle guide that is integral with the iron head 32. It is to be understood that the angle guide member 49 illustrated in FIG. 3 is parallel to the face grooves 19 previously mentioned in connection with FIG. 1. The elongated angle guide 49 can be welded to the rear side of the club head, or it could be riveted thereto in the manner shown in FIGS. 3 and 3A wherein a pair of rivets 50 are illustrated. It is to be understood that the cross section of the elongated angle guide 49 can be round, square,, rectangular, tubular, hexagonal or any other convenient form.

The angle guide is preferably removable from an iron head 32, for ease of replacement when such becomes necessary. By way of illustration, the angle guide can be attached to the club head by rivets, by welding, or by a combination of tack welding and rivets. As is obvious, to replace the angle guide, the weld and the rivet would need to be removed.

Figure 3A:
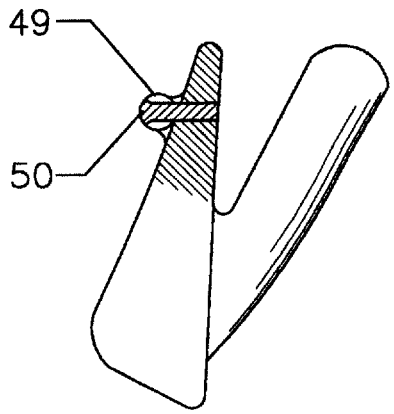
FIG. 3A is a toe side front cross sectional view of the iron club head depicted in FIG. 3, revealing further details of the attachment arrangement.

It is to be understood that I am not limited to the angle guide 49 being welded or riveted to the rear side of the iron club head as shown in FIG. 3A, for as is obvious, the angle guide could be cast integral with the club head.

Figure 4:
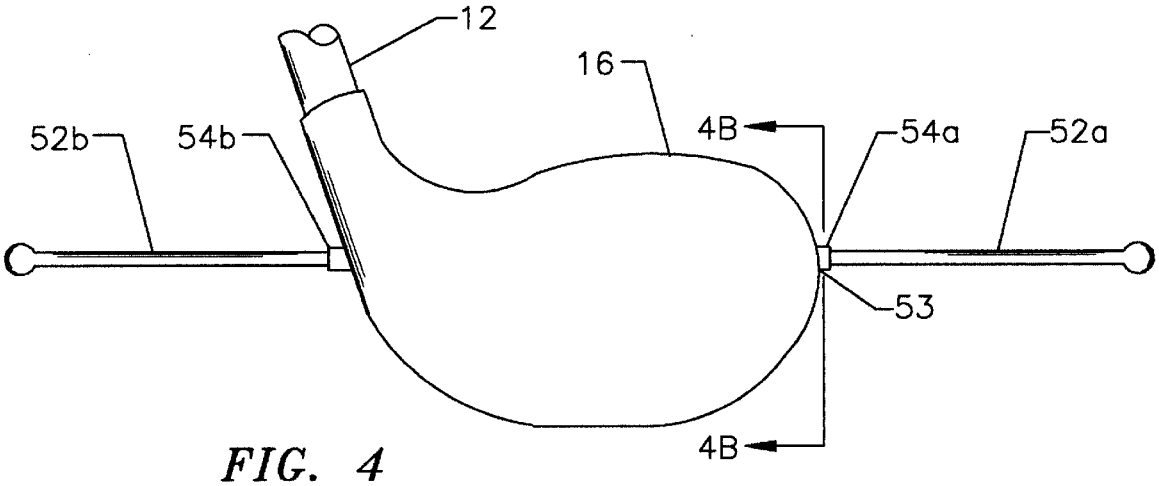
FIG. 4 is a view showing a typical version of my elongated angle guide mounted on a driver club head, which head may be made of wood, plastic or graphite.

Turning now to FIG. 4, it will be seen in this embodiment of my invention that I have illustrated the head 16 of a club, which may be persimmon, plastic, graphite or metal. A hole 53 has been drilled or otherwise formed in the clubhead 16, as shown in FIG. 4B with it to be understood that the hole 53 is in a parallel relationship to the laterally extending grooves 56 provided on the face of the club.

Figure 4A:
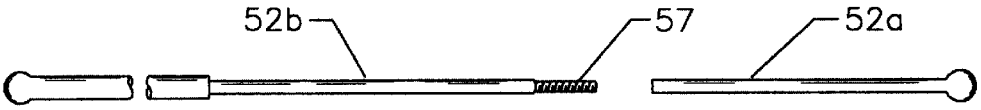
FIG. 4A is a view of the elongated angle guide after removal from the club head of FIG. 4, in this instance being made of somewhat dissimilar components.
Figure 4B:
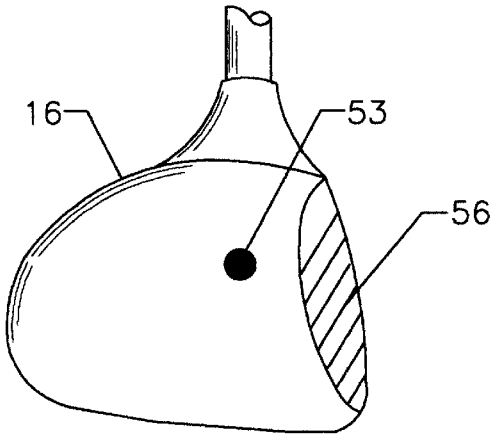
FIG. 4B is a view revealing the hole provided in the club head for accepting the elongated angle guide.

With reference to FIG. 4A it will be seen that a removable angle guide 52*a*–52*b* can be mounted in the hole 53 without it tending to fall at an improper time. For a permanent attachment the elongated angle guide can be welded or glued to the club head.

FIG. 4A further reveals that the member 52*b* is provided with male threads 57 at one end, which are intended to operatively engage female threads ( not shown) provided in the near end of component 52*a*. Spacers 54*a* and 54*b* are provided for tight fit. The members 52*a* and 52*b* are of course shown in their assembled relationship in FIG. 4. As is obvious, it is relatively easy for the golfer to install the novel elongated angle guide 52*a*–52*b* in the club head 16 merely by causing the internal threads of member 52*a* to threadedly engage the male threads 57 of member 52*b*.

The shoulders of members 52*a* and 52*b* will prevent the member from shifting. The shaft of member 52*b* that goes inside the club head has a smaller diameter than the main body of 52*b*. By screwing and tightening 52*a* and 52*b* the whole angle guide assembly will clamp tight to hold on to the club head.

This novel arrangement enables the golfer to easily install or readily remove the elongated angle guide so that when desired, the golfer can utilize his golf club in a normal manner to play golf or else practice his swing. Although the weight of the club is slightly affected, the club is designed to be functional with or without the angle guide. After a bit of use, the golfer will not be aware of the weight difference.

Figure 5:
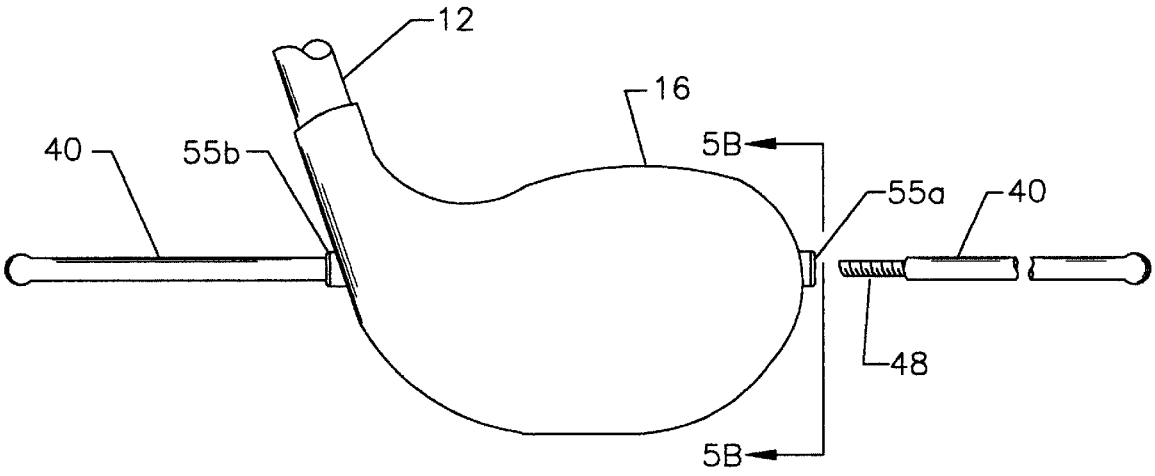
FIG. 5 is a figure resembling FIG. 4 but illustrating a somewhat different version of the mounting arrangement for the elongated angle guide.

With reference now to FIG. 5, it will be seen that I here reveal the utilization of my invention with a metal wood driver club head. Angle guide supports with female threads 55*a* and 55*b* are built integral with the club head, being conveniently located on the heel and toe portions of the club. The elongated angle guide support could for example be welded at the toe and the heel, or it could be provided by the club manufacturer at the time the club was being created.

As is in other embodiments of my invention, the axial center of this angle guide support is parallel to the grooves of the club face, and the general perimeter of the hitting surface when grooves are not provided. The tubular angle support is also parallel to the ground surface when the club is in its normal address position. As is obvious from FIG. 5, the angle guide member 40 with male threads 48 is attached to the angle guide support 55*a* and able to be easily tightened by the finger. As is also obvious from this figure, another angle guide member 40, also equipped with a male thread not (not shown) is attached to the angle guide support 55*b*. This arrangement enables the golfer to install or remove the angle guide easily.

Figure 5B:
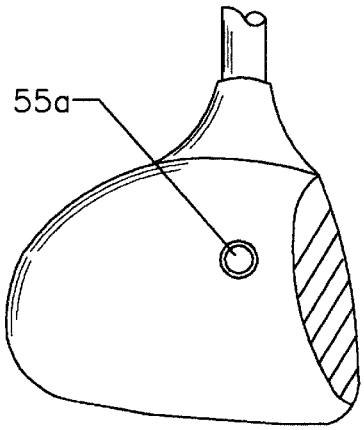
FIG. 5B is a view showing the angle guide support forming an integral part of a metal driver club head.

FIG. 5B reveals the general location of the female threads 55*a* provided in the clubhead to recieve the male threads 48 of member 40.

Figure 6:
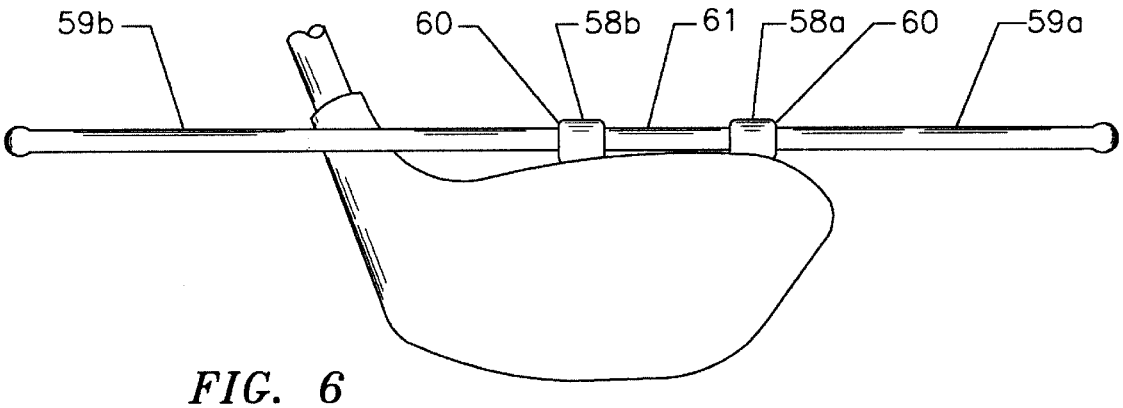
FIG. 6 is a view revealing another embodiment of my novel elongated angle guide, in this instance when mounted on a metal fairway driver club head.

FIG. 6 shows the embodiment of my invention in a typical fairway wood metal driver. Since the fairway wood metal driver is small, it is necessary to locate the elongated angle guide on top of the club head. There are many possible designs to attach the angle guide to the clubhead, one of which is as follows:

Angle guide supports 58*a* and 58*b*, provided with suitable holes 60, are built integral with the club head. The angle guide supports are located on top of the club head and are built such that the elongated angle guide, when installed in the support, will be parallel to the grooves on the club face, and the general perimeter of the hitting surface. Inasmuch as the clubface of the any driver has a slight buldge, the grooves are curved a bit, but the grooves may be regarded as almost residing in a straight line.

Figure 6A:
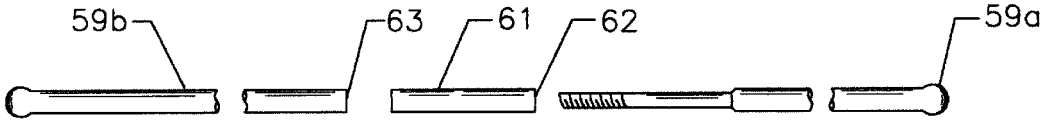
FIG. 6A is a view of the elongated angle guide of the type used in conjunction with the metal fairway driver club head of FIG. 6.

In FIG. 6A I reveal that a spacer 61 may be utilize, which spacer is equipped with a hole 62 extending therethrough.

The elongated angle guide 59*a* provided with male threads is initially inserted through hole 60 of the support 58*a*, then through spacer hole 62, and thereafter through hole 60 in member 58*b*. The female elongated guide component 59*b* is then threadedly attached to the male threaded end to form a complete unit.

Figure 7:
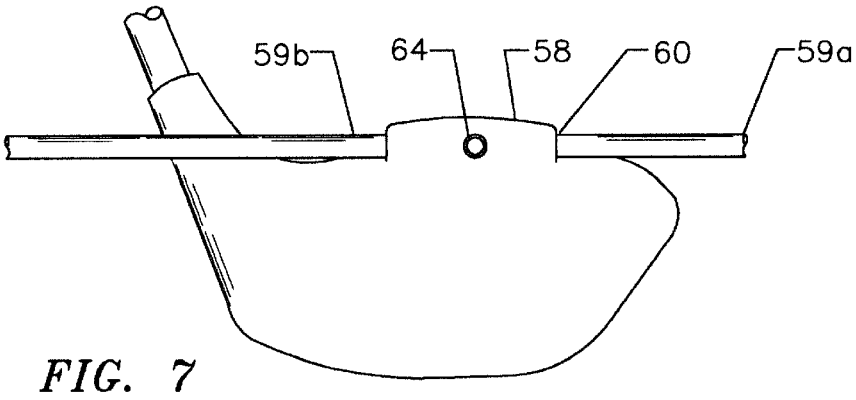
FIG. 7 reveals another embodiment of an arrangement in which my novel elongated angle guide can be used on a metal fairway club head or a metal driver club head.

FIG. 7 shows the embodiment of my invention adaptable to both the metal driver and fairway metal driver. The support is integral with the club head. The club head is built with an angle guide support on the top side of the club. The elongated angle guide is locked in place by a setscrew 64.

Figure 8:
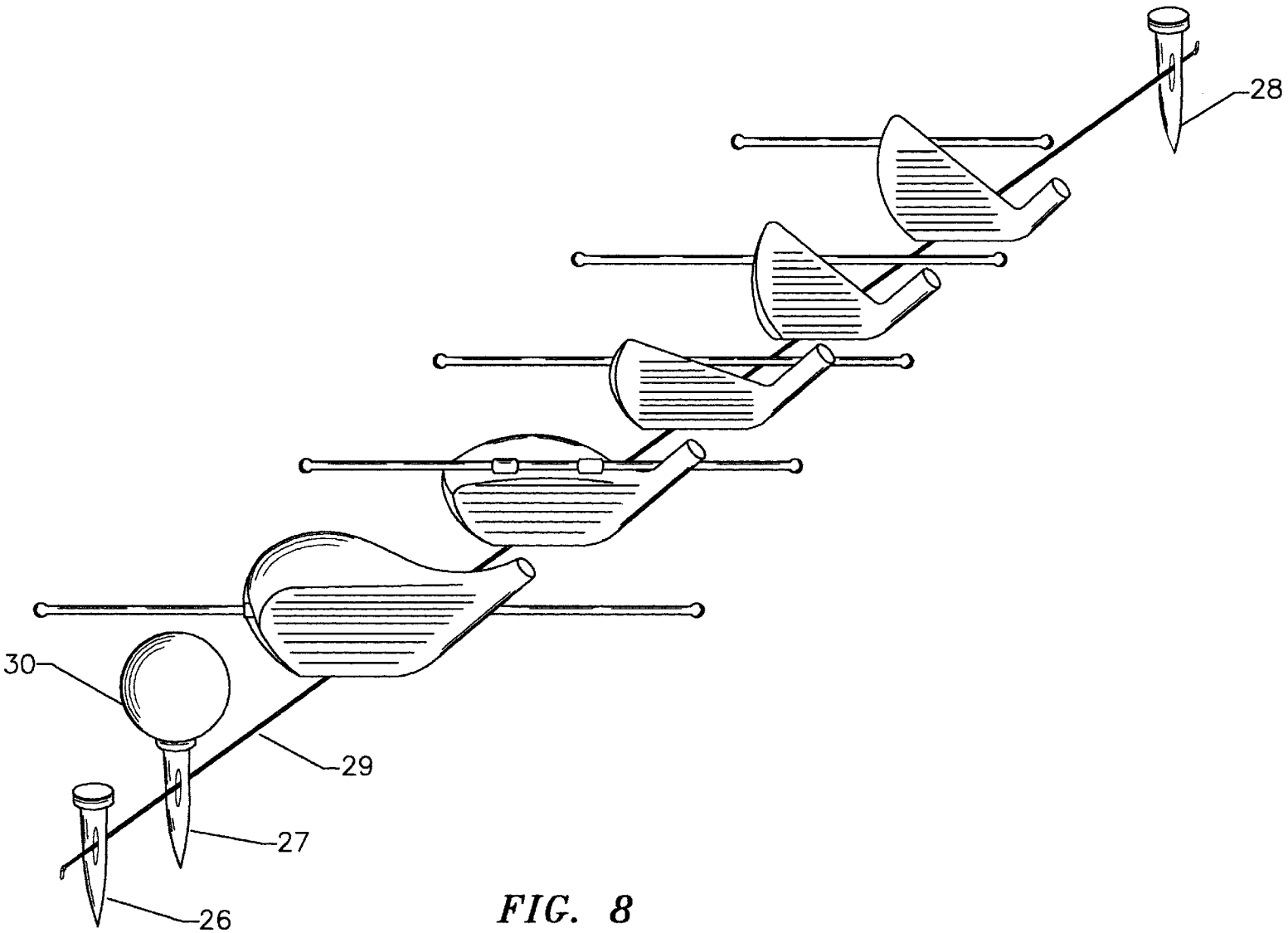
FIG. 8 is a view showing an array of club heads, with it being the purpose of this figure to show that my novel elongated angle guide can be utilized with a wide variety of club heads, including driver, fairway woods, the long iron, middle iron and short iron.

FIG. 8 is an array of golf clubs, with this view being intended to show that the elongated angle guide could be mounted on the different types of club including the so-called driver, the fairway woods, the long irons, the middle irons and the short irons. Also shown in this figure is the reference line marker or a visible string attached between tee posts and a practice golf ball A perpendicular relationship between the reference line marker and the elongated angle guide which is to be parallel to the ground surface will produce straight shots.

There are many variations or designs of how to attach the elongated angle guide to the club head. What is shown on FIG. 8 are sample mounting attachments of the elongated angle guide to the club head. The first club shown starting from left to right is the driver. The sample or typical elongated angle guide support attachment to the club head for the driver is shown on FIGS. 4 and 5. The second club is the fairway driver. The typical angle guide support attachment to the club head of the fairway driver is shown on FIGS. 6 and 7. It is to be understood that the typical angle guide support attachment shown on FIGS. 6 and 7 can be used also for the driver. The third club is the long iron, the fourth club is the middle iron and the last club is the short iron.

As to the utilization of my invention, I have previously made clear that a primary goal of my invention is to enable a golfer to hit the ball squarely with the club face. When the elongated angle guide is parallel to the ground and the clubface or the elongated angle guide is perpendicular to the imaginary line between the target and the ball, which is represented by the reference line marker, the hit is square making the ball move forwardly in the desired direction.

To this end I provide a novel angle guide, that when used in conjunction with a reference line marker, aids the golfer in learning to hit the ball accurately in the direction to the target.

The invention function by providing an accurate visual square or perpendicular relationship between the clubface and the target line which is represented by the reference line marker, and an accurate visual parallel relationship between the grooves of the club face and the ground surface at the address position. This is accomplished by the golfer by initially placing the elongated angle guide in a perpendicular relationship with the reference line marker and a parallel relationship with the ground surface at the time the golfer addresses the ball.

The address position is very important because it defines the start of the back swing and it is the correct position of the club before it strikes the ball during the forward swing.

The golfer primarily utilize the invention by creating the required shots by the use of the elongated angle guide and the reference line marker. To make a straight shot on a flat ground surface it is necessary for the center of the clubface to travel in a straight line parallel to the reference line marker continously towards the center of the golf ball, and the elongated angle guide must be maintained parallel to the ground and forms a perpendicular relationship with the reference line marker when viewed at the top of ball, few inches before and few inches after the ball impact. This is accomplished by the golfer by initially aligning the reference line marker towards the target, and setting the ball on the tee post in the middle of the reference line marker, and addressing the ball square by placing the center of the club face behind the ball and making the angle guide perpendicular to the reference marker and parallel to the ground. The golfer then makes the back swing and manipulates or makes adjustments in the different parts of his or her body during the forward swing such that the center of the club face travel in a straight line parallel to the reference line marker continously towards the center of the ball, and the angle guide is maintained parallel to the ground and perpendicular to the reference line marker when viewed at the top of the ball, few inches before and few inches after the ball impact. It is necessary to reduce the speed of the swing to see the path of travel of the club face and the relationship of the elongated angle guide with respect to the reference line marker and the ground surface and then increase the speed gradually as the golfer learns to swing the club properly.

The invention primarily function by enabling the golfer to take an instantaneous "snapshot" of the relationship of the elongated angle guide to the reference line marker and ground surface at the aproximate moment that the club strikes the ball. The "snapshot" relationship of the elongated angle guide to the reference line marker and ground surface at the moment of club impact determines the ball flight direction. The golfer will know the results of the swing without hitting the ball by looking down at the top of the ball and the "snapshot" relationship between the elongated angle guide the reference line marker and ground surface before the club impact. The golfer can purposely control his or her swing and stop the golf club before impact to see the "snapshot" relationship of the angle guide, reference line marker and the ground surface. The following are the possible "snapshot" relationship of the elongated angle guide, reference line marker and the ground surface looking down at the ball and the expected results of the ball flights; 1. If the toe side of the elongated angle guide leans or makes an angle to the right of the perpendicular position with the reference line marker and the elongated angle guide is parallel to the ground, the ball will travel to the right of the target; 2. If the toe side of the elongated angle guide leans or makes an angle to the right of the perpendicular position with the reference line marker and the elongated guide points to the ground or sky, the ball will travel to the right of the target; 3. If the toe side of the angle guide leans or makes an angle to the left of the perpendicular position with the reference line marker and the elongated guide is parallel to the ground, the ball will travel to the left of the target; 4. If the toe side of the elongated angle guide leans or makes an angle to the left of the perpendicular position and points up towards the sky the ball will travel to the left of the target.

The invention function effectively as a training device for practicing different types of controlled golf shots to develop muscle memory by repeatedly maintaining the desired relationship between the elongated angle guide, reference line marker and ground surface at the address position and during the golf swing.

It is to understood that the following claims are intended to cover all of the specific features of the invention herein describe and it is intended that all matters and features shown in the accompanying drawings shall be interpreted as illustrative and not in a limiting sense.

I claim:

1. A golf swing trainer to assist in the development of the proper swing to attain the proper desired static and dynamic alignment and position of the club face with respect to a fixed reference line marker, representing the target line at address, and the flat ground surface during the swing at impact for woods and irons for straight ball flight comprising:

a fixed visible reference line marker having a sufficient length on a flat ground surface;

a golf club having a head equipped with a visible elongated angle guide said head having a club face, and said elongated angle guide is located behind the said club face to free the said club face from obstruction on hitting the ball, said elongated angle guide is integrally molded to the said club head in a predetermined position parallel to the grooves of the said club face and the plane of the said club face, and said elongated guide having a toe end and heel end;

whereby the center of the said club face is maintained to travel parallel and directly above the said visible reference line marker and the said elongated angle guide is also maintained to travel perpendicular to the said visible reference line marker and parallel to the ground surface as the said head is stroked towards the ball for a straight ball flight to the target.

2. The swing trainer of claim 1, wherein the said elongated angle guide is attached permanently behind the said club face by an attaching means to the said club head and said elongated angle guide is positioned parallel to the grooves and plane of the said club face and said elongated angle guide having a visible toe end and heel end.

3. The swing trainer of claim 2, wherein the said elongated angle guide having extendable means.

4. A golf swing trainer to assist in the development of the proper swing to attain the proper desired static and dynamic alignment and position of the club face with respect to a fixed reference line marker, representing the target line at address, and the flat ground surface during the swing at impact for woods and irons for straight ball flight comprising:

a fixed visible reference line marker having a sufficient length on a flat ground surface;

a golf club having a head equipped with a means of support for a visible elongated angle guide said head having a club face, and said means of support and said elongated angle guide is located behind the said club face to free the said club face from obstruction on hitting the ball, said elongated guide is attached to the said means of support by attachment means, and said means of support holds the said elongated angle guide in the middle such that the said elongated angle guide having a visible toe end and heel end and said means of support is positioned such that the elongated angle guide is parallel to the grooves of the said club face and the plane of the said club face;

whereby the center of the said club face is maintained to travel parallel and directly above the said visible reference line marker and the said elongated angle guide is also maintained to travel perpendicular to the said visible reference line marker and parallel to the ground surface as the said club head is stroked forward towards the ball for a straight ball flight to the target.

5. The swing trainer of claim 4, wherein the said means of support is integrally molded to the said head, said means of support is positioned behind the club face and supports the said elongated angle guide parallel to the grooves and plane of the said club face, said means of support holds said elongated angle guide in the middle so as to have visible toe end and heel end.

6. The swing trainer of claim 4, wherein the said means of support is attached to the said head by attachment means and said means of support is positioned behind the said club face and supports the said elongated angle guide to parallel the grooves and the plane of the said club face, said means of support holds the elongated angle guide in the middle so as to have visible toe end and heel end.

7. The swing trainer of claim 4, wherein the said elongated angle guide having first and second member both having threads on one end, said means of support having threaded holes for engaging the threaded ends of the said elongated angle guide members.

8. The swing trainer of claim 4, wherein said elongated angle guide is releasably attached to the said means of support by releasably fastening means;, said elongated angle guide and means of support are located behind the club face and said elongated angle guide is positioned parallel to the grooves and plane of the said club face, said means of support holds said elongated angle guide in the middle so as to have a visible toe end and heel end.

9. The swing trainer of claim 4, wherein the said elongated angle guide is secured to the said means of support by connection means having tightening means.

10. The swing trainer of claim 4, wherein said elongated angle guide is secured to the means of support by a permanent attachment means.

11. The swing trainer of claim 4, wherein said means of support is defined by a hole in the said club head extending therethrough in a predetermined position with the said club face, said elongated angle guide having first and second member, said first member having a shoulder and an extended shaft that fits tightly inside the said hole of the said head and engages threadedly with the second member being equipped with a threaded hole and a shoulder on one end, whereby the first and second member of the said elongated angle guide clamps hold the said head between the said shoulders.

12. The swing trainer of claim 11, wherein the said elongated angle guide is secured to the said club hole by permanent means.

13. The swing trainer of claim 4, wherein the said reference line marker consist of a visible string with each end tied to a tee post being anchored to the ground, said tee post having a hole on the shaft to secure the said string end and to make the said string straight and taut, so as to aid the golfer in the proper alignment of the elongated angle guide.

14. A method of training a golfer to make the proper static golf alignment at address and to make dynamic straight swing shot, hook swing shot, and slice swing shot, for woods and irons consisting in steps of:

a) placing a reference line marker on flat ground surface and a ball on top and at the middle of the reference line marker;

b) making the proper static address with a golf club having an elongated angle guide by placing the club face center directly on top of the line marker and facing the center of the ball and making the elongated angle guide parallel to the ground surface to correct the lie angle, and by making the elongated angle guide perpendicular to the reference line marker to make the club square;

c) making the dynamic straight swing shot by making the back swing and stroking said golf club forward so that the center of the club is maintained to travel parallel and directly above the visible reference line marker and the elongated angle guide is also maintained to travel perpendicular to the reference line marker to make square contact with the ball and also parallel to the ground surface to maintain proper lie angle as the club face travels to strike the ball;

d) making the dynamic hook swing shot by repeating steps a) and b) and by making the back swing and stroking the golf club forward so that the center of the club face is maintained to travel parallel and directly above the visible reference line marker and the elongated angle guide is also maintained to travel with either or combination of; toe end maintained to travel tilted up; maintaining the elongated angle guide to travel parallel to ground surface and the toe end to lead with a small angle with the imaginary perpendicular line with the reference line marker;

e) making the dynamic slice swing shot by repeating steps a) and b) and by making the back swing and stroking the golf club forward so that the center of the club face is maintained to travel parallel and directly above the visible reference line marker and the elongated angle guide is also maintained to travel with either or combination of: toe end maintained to travel tilted down; maintaining the elongated angle guide to travel parallel to ground and the toe end to lag behind with a small angle with the imaginary perpendicular line with the reference line marker, as the club travels to strike the ball.

* * * * *